US005287817A

United States Patent [19]

Lees, Jr. et al.

[11] Patent Number: 5,287,817

[45] Date of Patent: Feb. 22, 1994

[54] EMERGENCY SHUTDOWN SYSTEM FOR A HAZARDOUS WASTE INCINERATOR

[75] Inventors: John N. Lees, Jr., Brookfield, Wis.; Allen B. Beaudin, Danville, Calif.

[73] Assignee: Svedala Industries, Inc., Waukesha, Wis.

[21] Appl. No.: 17,010

[22] Filed: Feb. 12, 1993

[51] Int. Cl.[5] ..... F23N 5/24

[52] U.S. Cl. ..... 110/193; 110/210; 110/212; 110/235; 588/205; 588/228

[58] Field of Search ..... 110/193, 185, 235, 234, 110/349, 210, 212, 214; 588/205, 228

[56] References Cited

U.S. PATENT DOCUMENTS 4,702,178 10/1987 Welsh ..... 110/193

5,048,430 9/1991 Kawai ..... 110/193

*Primary Examiner*—Edward G. Favors

*Attorney, Agent, or Firm*—Robert B. Benson

[57] ABSTRACT

A system for the controlled safe shutdown of a hazardous waste incinerator upon loss of power. The system includes a primary combustion chamber and a secondary combustion chamber, a gas treatment system, and two standby power sources. One standby power source is available immediately for elements that cannot be shut down even for a second. The other standby power source is a heavy duty generator that takes a short time to get up to speed but is used to power elements that can be allowed to coast for a short time without causing damage to the equipment or the environment. The system includes an uninterruptable power source connected to continue supplying heat and air to the secondary combustion chamber and prevent opening an emergency vent stack cap and thereby prevent the unwanted discharge of gas from the system. At the same time that power is lost, a standby generator is activated to power other elements of the system such as the heavy duty fan that draws the gas through the combustion chambers, spray dryer reactor and filters. The standby generator is needed because the much heavier loads it powers could not be accommodated by the battery based uninterruptable power supply, and the fact that there can be a slight delay between loss of power and operation by the generator without damage to the system or the environment.

5 Claims, 1 Drawing Sheet

EMERGENCY SHUTDOWN SYSTEM FOR A HAZARDOUS WASTE INCINERATOR

BACKGROUND OF THE INVENTION

Currently there are many areas of land in the world that have soils contaminated by hazardous materials such as organic compounds and inorganic metal compounds. Examples or organic contaminants are various hydrocarbon ring compounds such as benzene, toluene, ethylbenzene, and zylene compounds (commonly known as BTEX); polynuclear aromatic hydrocarbons (known as PAH); and chlorinated hydrocarbons. Examples of inorganic metal compounds are arsenic, lead, cadmium, and zinc, and their various oxides. It has been recognized that it is highly desirable that these hazardous materials do not end up in the atmosphere we breathe or the water we drink, therefore the goal of environmental remediation activities has been to destroy or remove the organic contaminants, and to stabilize or prevent the migration of the inorganic metals and their compounds into the ground water.

DESCRIPTION OF PRIOR ART

Presently these contaminants are removed from the soil by various thermal treatment processes. Thermal processes convert organic contaminants in the soil to non-hazardous compounds by the use of heat. The thermal process normally uses the combustion of fuels to heat the soil, but is not limited to combustion processes. A device commonly used is a combustion chamber such as a rotary kiln. As the soil is heated in the rotary kiln, the organic contaminants are volatilized and move into the gas stream of the products of combustion above the tumbling bed of soil in the kiln. The gases which contain the organic compounds may then be treated in a secondary combusion chamber or they may be cooled to a very low temperature to condense the organic compounds so they may be collected on activated carbon to remove them from the gas stream.

PROBLEMS WITH THE PRIOR ART

Most hazardous waste incinerators have an emergency relief stack to vent the incinerator during upset conditions. This vent stack is frequently located at the top of the secondary chamber to allow natural draft to pull waste gases and heat from the system to avoid equipment damage.

The goal of any incinerator shutdown system is to protect the environment, personnel, and equipment in the event of a process emergency. The emergency vent stacks are protective of the personnel and equipment but do not provide complete environmental protection. Therefore it is desirable to have a system that has the necessary features to protect personnel, environment and equipment.

Vent stacks open for a variety of conditions but most open due to loss of power, major equipment failure, loss of air pollution control system, and loss of control. It is possible to reduce frequency of vent stack opening by increasing equipment and control redundancy, but the vent stack will still open where there is loss of power.

The emergency shutdown system of this invention is designed to keep the gas treatment portion of the system operating at reduced capacity in the event of a power failure rather than having the vent stack open. This system can be utilized on solid waste incinerators where the contaminants continue to emit hazardous organic gases after a shutdown due to residual heat in the primary combustion chamber. The system has the following key elements: a continous firing secondary combustion chamber utilizing a control system and fan supplied with power through an uninterruptable power supply; an air pollution control system that continues to cool the gas and remove particulates and acid gases; and a system induced draft fan utilizing a two-speed motor with standby generator backup to draw the gases throuogh the combustion chamber and the air pollution control system.

Should a power failure occur, the primary combustion chamber would cease to have contaminated soil and heat input. However organic compounds would continue to be volitalized from the soil in the primary combustion chamber due to the residual heat in the soil and the refractory lining or steel shell of the primary combustion chamber. The secondary combustion chamber would continue to operate on uninterrupted power source. When the emergency standby generator is started it supplies power to the fan to keep the gas treatment portion of the system operating at a reduced level.

The system induced draft fan requires a very large motor to pull the gas through the system under normal operating conditions. The power necessary to keep the fan running is significant and an uninterrupted power source designed to operate this fan is undesirably large. This problem is overcome by use of a fan motor having a reduced speed capability. Once a power failure occurs, the normal fan motor no longer receives power. However, a fan has significant inertia and continues to rotate. The standby generator is immediately started when a power failure occurs and is ready to assume a load in less than one minute. The fan motor is reenergized at its low speed operation once the fan rotation reduces to the second speed, thus the fan continues to draw gas through the system and is designed to operate at a reduced speed during the emergency shutdown period.

The requirements for a safe shutdown vary with system size but typically 30–60 minutes is sufficient to allow volatilization of all organic compounds from the soil in the primary combustion chamber due to residual heat. This design is intended to supplement rather than to replace the typical safe systems that are normally present in a hazardous waste incinerator.

SUMMARY OF INVENTION

This invention contemplates an emergency shutdown system for hazardous waste treating systems including two separate standby power sources to prevent the escape of toxic gases from the system while operating the system at a reduced level until the volatizilation of the contaminants in the soil being treated is complete.

DESCRIPTION OF THE PREFERRED EMBODIMENT

Figure 1:
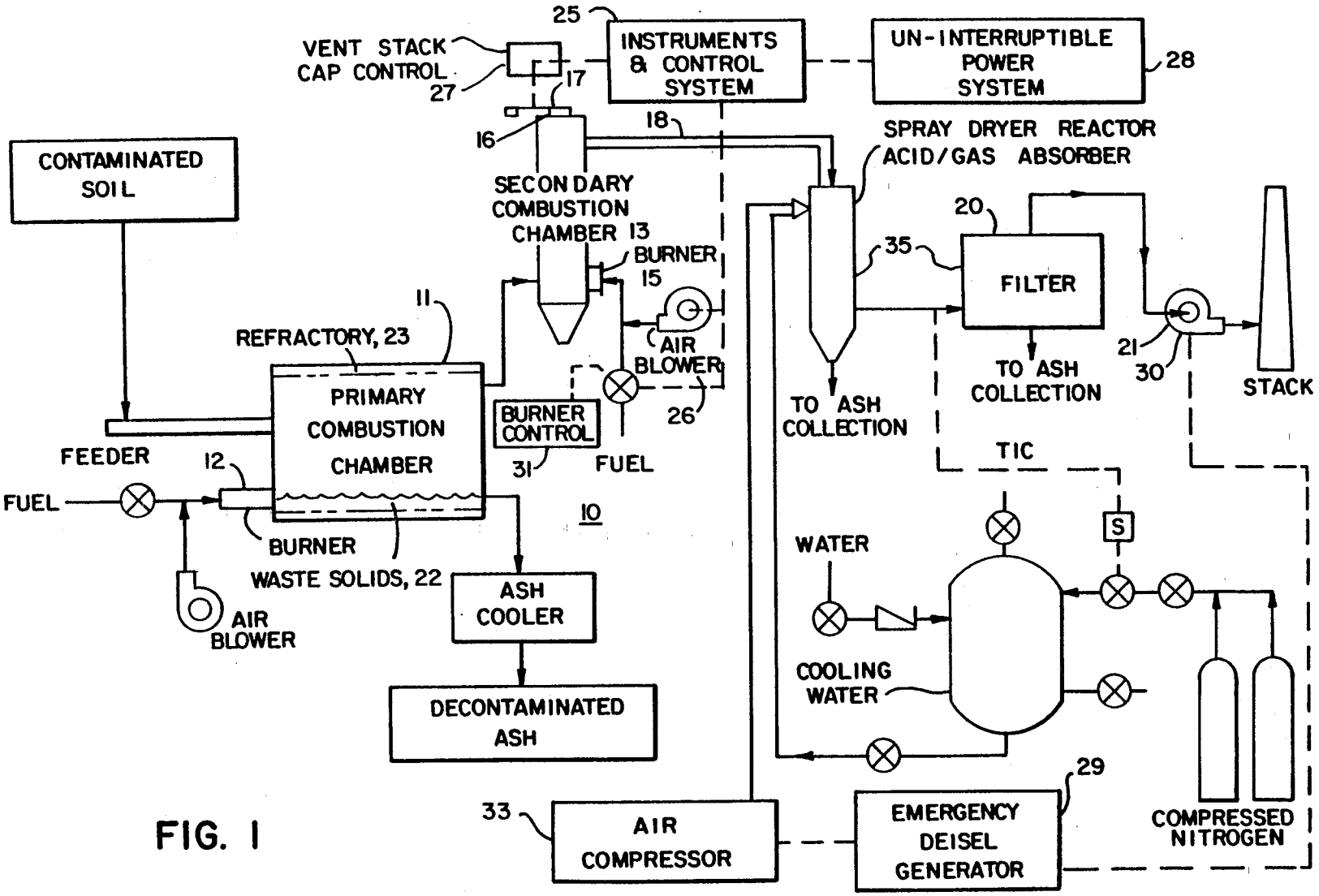
FIG. 1 is a schematic of a hazardous waste treatment system incorporating the emergency shutdown system of this invention.

The illustrated hazardous waste incinerator system 10 includes a primary heating and combustion chamber 11 such as a rotary kiln. Soils or other solid waste materials 12 contaminated with hazardous organic and inorganic materials are fed to the primary combustion chamber 11 where they are heated by an air-fuel burner to a temperature level of 800° F. to 1400° F. by a typically oxygen-rich fuel air flame to volatilize and burn the organic compounds. When the volatizied organic compounds are completely burned in an air-rich flame, a very small mass may remain unburned, and a very small mass of partially oxidized toxic compounds may form. In either case if these gases are allowed to discharge into the environment, they would create a hazard to human life.

The gaseous products of combustion of the flame and the organic compounds leave the first combustion chamber 11 and flow to a secondary combuston chamber 13 for further thermal treatment of the gas. The treatment in the secondary chamber 13 consists of heating the gas in the chamber to a temperature level in the range of 1800° F. to 2200° F., and holding the gas at that temperature level for a period of about two seconds residence time in an atmosphere rich in molecular oxygen. A burner 15 supplied by fuel and air is connected to the secondary chamber 13 to provide additional heat and air in the chamber. When the hazardous compounds are subjected to the conditions in the second combustion chamber 13, they experience a high chemical potential to react with the oxygen in the chamber and are consumed to form fully oxidized water vapor, carbon dioxide, sulphur dioxide, and hydrogen chloride. This additional thermal treatment of the gas is necessary to destroy the unburned and partially oxidized organic compounds in the gas before it leaves the combustion chamber. An emergency vent stack 16 and cap 17 are provided at the top of the secondary combustion chamber to be opened in an emergency, such as utility power loss, to provide a natural draft to draw the gas from the primary chambers and discharge such gas to the environment while maintaining the chambers at a negative pressure.

These fully treated gases could be directly discharged to the environment through the emergency vent stack 16 during power outage with only minor particulate and gas related impact on the environment. However, it is preferred to direct the gas from the second combustion chamber 13 through the duct 18 connected to the secondary chamber into the spray dryer 19 and filter 20. The system induced fan 21 draws the gas through the entire system to maintain a negative pressure in all parts of the system during normal operation while the emergency vent stack cap 17 is closed.

When incineration systems such as this operate, they sometimes experience an interruption in electric power supply due to electrical storms, utility distribution system malfunction, or other unexpected events. When such a loss of power occurs, all electrically operated devices in the system come to a stop. While fresh feed, fuel and air are thus stopped from entering the incineration system, the stored heat in the solids material 22 and refractory 23 in the primary combustion chamber causes the volatilization process to continue, although at a reduced rate.

Since the system induced draft fan 21 normal drive motion also stops, this continued production of gas in the primary combustion chamber 11 could cause the pressure in the combustion chamber to rise to a level above atmospheric pressure such that the gas would leak out through the seals in the primary combustion chamber 11. This hot, noxious gas leak would damage the seals and could injure maintenance and service persons in the vicinty of the incinerator. To avoid this condition, an emergency vent cap 17 is positioned at the top of the emergency vent stack at the top of the secondary chamber 13 to be opened at the time of loss of power. However, this is undesirable because particulates and acid gas would be released to the environment.

In our invention, we provide an uninterruptable power source 28 such as a battery to supply electrical power to the incineration system control 25, secondary combustion chamber burner 15 and air fan 26, and emergency vent stack cap control 27. We also provide an emergency diesel powered electrical generator 29 to power the motor 30 on the induced draft fan 21. The uninterrupted power source 28 and emergency diesel powered electrical generator 29 provide power to keep the secondary combustion chamber 13 and the air pollution control system operating during a failure in utility supplied electrical power.

At the instant of utility power failure, the uninterruptable power source keeps the secondary combustion chamber burner controls 31 and air fan 26 running and the vent cap 17 closed. Mechanical inertia keeps the system fan 21 rotating allowing it to coast to reduced speed. At the reduced speed it continues to provide draft while it coasts keeping the gas in the chambers at negative pressure. The emergency diesel powered electrical generator 29 starts promptly at the instant of utility power loss and is able to supply power within about one minute. The generator supplies power to the motor through a motor controller when the speed of the motor approaches its lower rated speed, for example 50% of the fan's normal speed. This lower fan speed can be maintained with much lower electrical power consumption, but is sufficient to maintain a gas flow of about 12% of normal, well above the volume requirement during the safety shutdown period to keep the pressure in the chambers at a negative level. Emergency diesel electrical power is also supplied to the air compressor system 33 which supplies compressed air to the air atomized water lime slurry atomizing nozzles in the spray dryer reactor 19 to continue to cool the gas moving from the secondary combustion chamber 15 to the filter 20 and the fan 21.

The air pollution control system 35 will continue to provide emergency gas cooling powered by the uninterrupted power source/generator system or by compressed air. The air pollution control system would atomize water to cool the gas. The cooled gas would pass through the particulate collector where residual reagents would remove any acid gases.

Although this invention has been described in connection with treating contaminated soil, it could also be used with other materials containing similar contaminants.

The embodiments of the invention in which an exclusive property or privilege is claimed are defined as follows:

1. An emergency shutdown system for a hazardous waste incinerator having:

A. a primary combustion chamber,

B. means for feeding material containing hazardous waste to said primary chamber, C. a heater for providing sufficient heat to said primary chamber to volatilize the hazardous waste material, D. a secondary combustion chamber positioned to receive volatilized gas from said primary chamber, E. means for providing heat and oxygen to said secondary combustion chamber to further treat the gas in a secondary combustion chamber, F. a system induced draft fan for controlling the flow of gas through said combustion chambers, G. a main power source for operating said feed means, said heater, said means for providing heat and oxygen to said secondary chamber and said fan, H. an uninterrupted power source connected to said means for providing heat and oxygen to said secondary combustion chamber upon interruption of said main power source.

I. an auxiliary power source energizable upon an interruption of the main power source, and J. control means for connecting said auxiliary power source to said fan to keep the system operating until all hazardous waste in the primary combusion chamber has been treated.

2. The system of claim one in which the uninterruptable power source is a set of storage batteries.

3. The system of claim one in which the auxiliary power source is a diesel generator.

4. The system of claim one in which a vent cap is mounted on top of said secondary combustion chamber and is connected to the uninterrupted power source to keep said cap in a closed position upon loss of power until all contaminants in the system are treated.

5. The system of claim three in which said draft fan is driven by a two-speed motor connectable to said diesel generator.

* * * * *